US005684355A

United States Patent [19]

Seredich et al.

[11] Patent Number: 5,684,355

[45] Date of Patent: Nov. 4, 1997

[54] METAL STRAP FOR HOLDING CYLINDRICAL LAMP

[75] Inventors: Douglas G. Seredich, Montville; Thomas R. Norris, Willoughby; Gino Savarino, Cleveland Heights; Thomas H. Yu, Richmond Heights; John J. Stewart, Mentor, all of Ohio

[73] Assignee: General Electric Company, Schenectady, N.Y.

[21] Appl. No.: 511,511

[22] Filed: Aug. 4, 1995

[51] Int. Cl.[6] ..... H01J 5/50

[52] U.S. Cl. ..... 313/318.01; 313/318.02; 313/252; 313/292; 439/232

[58] Field of Search ..... 313/318.01, 318.02, 313/252, 292, 25, 634; 439/432

[56] References Cited

U.S. PATENT DOCUMENTS

| | | | |
|---|---|---|---|
| 4,570,210 | 2/1986 | Kosmatka | 362/395 |
| 4,602,185 | 7/1986 | Roiz et al. | 313/25 |
| 5,075,586 | 12/1991 | Jaeger et al. | 313/25 |
| 5,216,319 | 6/1993 | Van Heeswijk | 313/318.01 |
| 5,386,173 | 1/1995 | Kosmatka . | |
| 5,510,967 | 4/1996 | Coushaine et al. . | |

FOREIGN PATENT DOCUMENTS

| | | |
|---|---|---|
| 367343 | 5/1990 | European Pat. Off. . |
| 478058 | 9/1991 | European Pat. Off. . |
| 490702 | 6/1992 | European Pat. Off. . |

*Primary Examiner*—Sandra L. O'Shea
*Assistant Examiner*—Vip Patel
*Attorney, Agent, or Firm*—George E. Hawranko

[57] ABSTRACT

A lamp is provided with a mounting arrangement for achieving a precise alignment. The lamp includes a double-ended light source, a metal strap clamping one end of the light source at two locations, and a plastic base having an internal opening wherein the metal strap is engaged. The metal strap includes two clamping members between which the light source is clamped and a cap member attached to the clamping members. The cap member has tabs adapted for engaging the internal opening of the plastic base and gimbaling the light source to align the light source with respect to the plastic base. The clamping members are joined together at a point between the to clamping locations such that a spring force clamps the light source. The clamping members are also oriented at an angle of about 45 degrees from vertical to better withstand both vertical and horizontal loads.

24 Claims, 3 Drawing Sheets

METAL STRAP FOR HOLDING CYLINDRICAL LAMP

BACKGROUND OF THE INVENTION

1. Field of the Invention

The present invention generally relates to a replaceable bulb for automotive headlamps and more particularly to such a replaceable bulb having a metal strap for aligning and locking a light source in a fixed position with respect to a base.

2. Description of Related Art

With automotive designs tending to require smaller headlamp packaging, smaller light bulbs must be utilized which operate at higher temperatures, up to 700 degrees centigrade, due to their small size. These light sources are typically, but not limited to, the double-ended type. The light source is typically fixed in a plastic base to form a replaceable bulb which is installed within the headlamp assembly. Proper alignment and stability of the light source inside the headlamp assembly are important requirements for the performance of the headlamp. Therefore, the light source is aligned in a specific position with respect to the plastic base to ensure alignment of the light source in the headlamp assembly.

A gimbal device is one of the mechanisms typically used to align the light source with respect to the plastic base. The gimbal device, which serves as a holder for the light source, generally extends into a cylindrical opening of the plastic base from which the light source can be aligned. After alignment, the gimbal device is attached to the plastic base by either thermal or mechanical means so as to secure the light bulb in the aligned position.

Once installed in the headlamp assembly, the replaceable bulb must conform to Federal Motor Vehicle Safety Standard 108. The standard demands that the replaceable bulb mounted inside the headlamp assembly does not permanently deflect beyond a specified distance of 0.005 inches in response to a 4 pound force applied perpendicular to its longitudinal axis. A tight reliable joint between the gimbal device and the plastic base is critical to ensure that the replaceable bulb meets this deflection specification.

Typical gimbal devices include a glass or ceramic member in order to insulate the plastic base from the heated light source. For example, see U.S. Pat. No. 5,386,173, the disclosure of which is hereby expressly incorporated herein by reference in its entirety, which discloses a gimbal device having glass-mica member. The ceramic members, however, may cause cracks which penetrate the light source tube due to a thermal mismatch between the ceramic member and the quartz tube. Additionally, the ceramic members are relatively brittle and may be easily damaged by mechanical shocks or impacts. Accordingly, there is a need in the art for a replaceable bulb for an automobile headlamp with improved thermal and mechanical shock resistance.

SUMMARY OF THE INVENTION

The present invention provides a lamp with a mounting arrangement for achieving a precise alignment that overcomes at least some of the above noted problems. The lamp includes a double-ended light source, a metal strap clamping one end of the light source at two locations, and a plastic base having an internal opening wherein the metal strap is engaged. The metal strap deflects during shock impacts and thereby enables the lamp to be more durable during handling and use. However, because the light source is clamped at two locations, the lamp can meet the deflection specification. Additionally, the metal strap reduces the thermal mismatch with the light source. Furthermore, the metal strap takes significantly less time and energy to attach the plastic base than prior art gimbal devices.

BRIEF DESCRIPTION OF THE DRAWINGS

These and other features and advantages of the present invention will be apparent with reference to the following description taken in conjunction with the accompanying drawings, wherein.

DETAILED DESCRIPTION OF PREFERRED EMBODIMENTS

Figure 1:
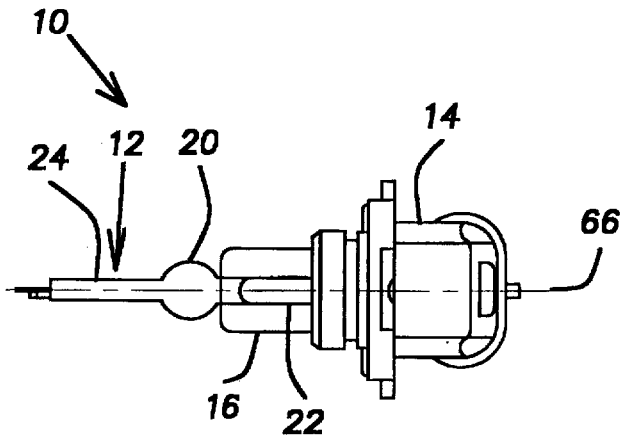
FIG. 1 is a top plan view of a replaceable bulb for an automotive headlamp having a metal strap according to the present invention.

FIGS. 1–5 illustrate a replaceable bulb 10 of an automotive headlamp according to the invention. An old bulb is replaced by installing a new bulb into a headlamp fixture (not shown) in a manner that is standard for this type of replaceable headlamp bulb 10. The replaceable bulb 10 includes a light source 12, a plastic base 14, and a metal strap or gimbal device 16.

The light source 12 of the illustrated embodiment is of the double-ended type having an outer envelope 18 made of quartz material. The light source 12 can be of other types. The light source is a high-temperature light source, that is, it operates at temperatures in the range of about 200 degrees centigrade to about 900 degrees centigrade. The envelope 18 has a central bulbous section 20 and a pair of generally cylindrically-shaped inner and outer neck sections 22, 24 longitudinally extending from the bulbous section 20. Inner and outer lead wires 26, 28 emerge from the respective neck sections 22, 24 and are encapsulated by the neck sections 22, 24. The outer lead wire 28 is connected to an external conductor wire 30 that longitudinally extends into the plastic base 14. The inner lead 26 is connected to an internal conductor wire 32 within the plastic base 14. Within the plastic base 14, the conductor wires 30, 32 are connected to terminals 34 such that the light source 12 can be connected to an electrical source (not shown) in a conventional manner.

The plastic base 14 is constructed from a high temperature plastic and contains a cylindrically-shaped internal space or opening 36 into which an inner end of the light source 12 extends and is supported by the metal strap 16. The plastic base 14 is of a configuration that it can be mounted into the headlamp fixture in a manner that is consistent with industry practice.

Figure 5:
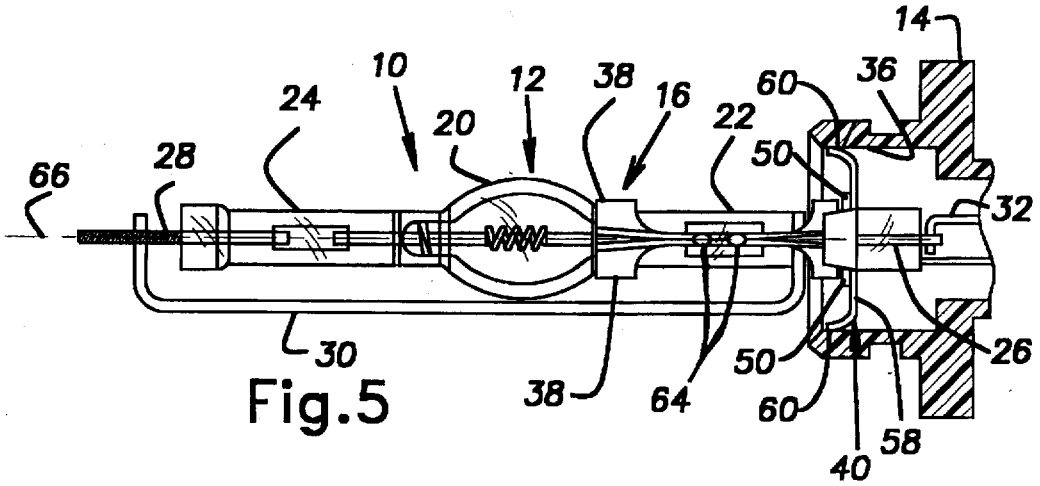
FIG. 5 is an enlarged fragmented view, in partial cross-section, of the replaceable bulb taken along line 5—5 of FIG. 4.
Figure 6:
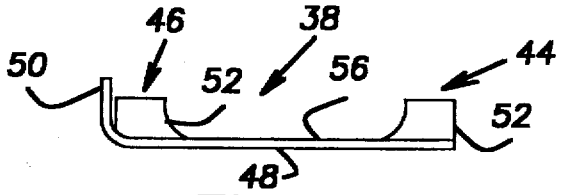
FIG. 6 is a side view of a clamping member of the metal strap.
Figure 7:
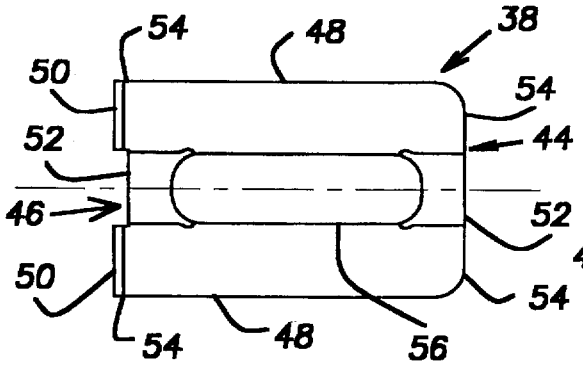
FIG. 7 is a plan view of the clamping member of FIG. 6.
Figure 8:
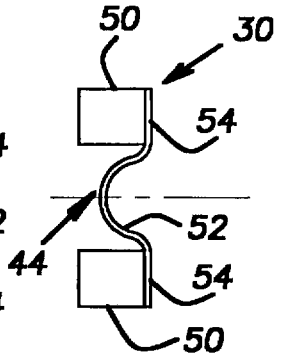
FIG. 8 is an end view of the clamping member of FIG. 6.

As best shown in FIG. 5, the metal strap 16 includes a pair of clamping members 38 and a cap member 40. The clamping members 38 and the cap member 40 are each formed from a suitable metal such as, for example, stainless steel, steel-Ni alloy, or Ni—Ag alloy. As best shown in FIGS. 6–8, each clamping member 38 includes inner and outer clamping straps 44, 46, two connecting arms 48 and two attachment tabs 50 which are all integrally formed. The clamping straps 44, 46 each have a central arcuate portion 52 and rectangularly-shaped legs 54 extending outwardly therefrom. The arcuate portion 52 is sized such that, when joined with an associated clamping strap of another clamping member 38, a cylindrically-shaped nest is formed for the inner neck section 22 of the light source 12. The connecting arms 48 are generally coplanar with and connect the legs 54 of the inner and outer clamping straps 44, 46 and the arcuate portions 52 of the connecting straps 44, 46 are generally coaxial. The connecting arms 48 are sized such that the inner and outer clamping straps 44, 46 are longitudinally spaced apart to adequately supports the light source 12. A central opening 56 is formed between the clamping straps 44, 46. The attachment tabs 50 are generally rectangularly-shaped and perpendicularly extend outwardly from the legs 54 of the inner clamping strap 44.

Figure 9:
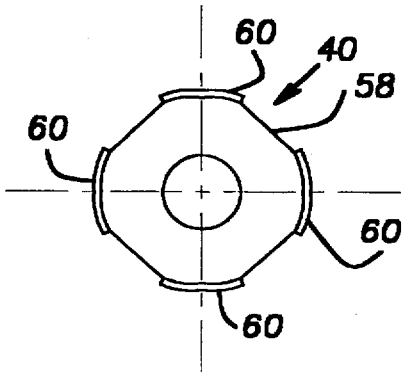
FIG. 9 is an end view of a cap member of the metal strap.
Figure 10:
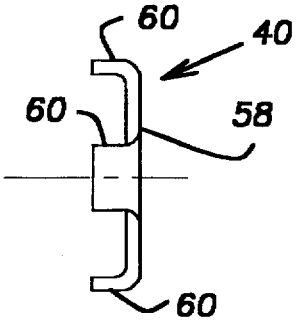
FIG. 10 is a side view of the cap member of FIG. 9.

As best shown in FIGS. 9 and 10, the cap member 40 includes a planar base 58 and four connecting tabs 60 extending from the base 58. The base 58 has a central circular opening 62 sized for allowing the inner neck section 22 to pass therethrough with clearance. The connecting tabs 60 are generally rectangularly-shaped and are equally spaced about the periphery of the base 58. Outer surfaces of the connecting tabs each have a radius which corresponds to the diameter of the internal opening 36 of the plastic base 14. Preferably, the connecting tabs 60 angle forwardly and outwardly from the base 58 as best shown in FIG. 10.

As best shown in FIG. 5, the metal strap 16 clamps the inner neck section 22 of the light source 12 between the two clamping members 38. The clamping members 38 clamp the neck section 22 at each of the spaced apart pairs of clamping straps 44, 46. The two clamping members 38 are attached together by welds 64. Preferably, the welds 64 are located near the center of the clamping members, that is, on the connecting arms 48 between the clamping straps 44, 46. Welding in this manner allows the clamping members 38 to deflect outwardly at the ends, as best shown in FIG. 5, so that a spring force clamps the neck section 22 at both locations of the clamping straps 44, 46. Accordingly, the arcuate sections 52 of the clamping members 44, 46 are sized such that they do not fully encircle the neck section 22 of the light source 12. Clamping with a spring force enables relatively large variations in the diameter of the neck section 22 to be accommodated. The spring force also enables the metal strap 16 to have more flexibility or "give" so that the lamp 10 can tolerate larger impact forces while still meeting the deflection specification. Alternatively, the welds 64 can be located on the clamping straps 44, 46 for more strength. However, the metal strap 16 would be more rigid and the tolerance of the neck section 22 must be more closely controlled.

Figure 4:
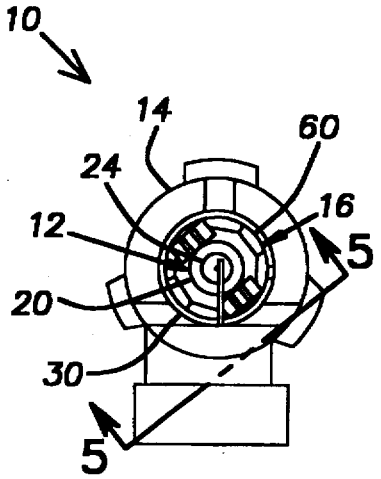
FIG. 4 is an end view of the replaceable bulb of FIG. 1.
Figure 2:
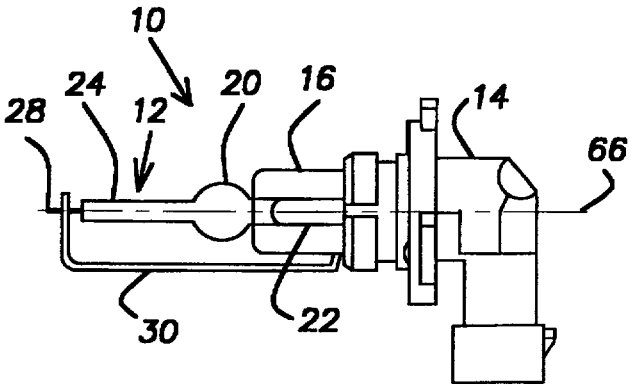
FIG. 2 is a side view of the replaceable bulb of FIG. 1.
Figure 3:
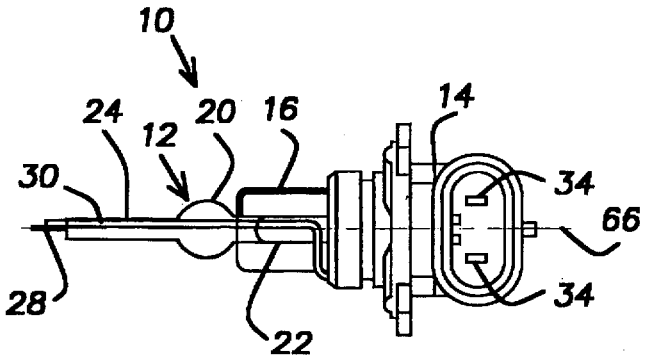
FIG. 3 is a bottom plan view of the replaceable bulb of FIG. 1.

The clamping members 38 are attached to the cap member 40 by welding the attachment tabs 50 to the outer side of the base 58 as best shown in FIG. 5. The clamping members 38 are preferably oriented such that the interface between the two clamping members 38 is generally perpendicular to two of the connecting tabs 60 of the cap member 40 as best shown in FIG. 4.

The cap member 40 of the metal strap 16 is inserted into the opening 36 of the plastic base 14 so that the outer surfaces of the connecting tabs 60 are in contact with the inner surface of the internal opening 36 as shown in FIG. 5. Preferably, the cap member 40 is sized such that the connecting tabs 60 engage the inner surface of the opening 36 with a spring force. In the illustrated embodiment, the metal strap 16 is oriented such that the interface between the clamping members 38 is about 45 degrees from vertical. Such an orientation enables the replacement lamp 10 to better withstand both vertical and horizontal loading.

Once inserted in the plastic base 14, the metal strap 16 is free to gimbal, that is, free to slide axially along the longitudinal axis 66 and to rotate about the longitudinal axis 66 and the two axes perpendicular thereto. The gimbaling of the metal strap 16 enables the light source 12 to be properly oriented with respect to the plastic base 14 so that it will be in focus when assembled into the headlight fixture. Once the light source 12 is properly oriented with respect to the plastic base 14 the metal strap 16 is heated by application of Radio-Frequency (RF) energy whereupon the heat causes softening of the plastic base 14 near the connecting tabs 60 of the metal strap cap member 40. The metal strap cap member 40 expands and plastic of the plastic base 14 flows around the edges of the connecting tabs 60 thus interlocking the metal strap 16 to the plastic base 14 to form a rigid reliable joint.

Contact between the metal strap 16 and the light source 12 is minimized because of the high thermal conductivity of the metal strap 16. Heat output from the light source 12 could overheat the plastic base 14 if enough heat is transferred through the metal strap 16. Accordingly, the metal strap 16 is adapted to minimize contact with the light source. The clamping straps 44, 46 are sized effective to both minimize contact with the neck section 22 of the light source 12 and to provide enough clamping force to meet the deflection specification. Contact between the metal strap 16 and the plastic base 14 is also minimized. The connecting tabs 60 are sized effective to minimize contact with the plastic base 14, to adequately gimbal to align the light source 12, and to provide an adequate joint to meet the deflection specification. It is noted that the only contact between the metal strap 16 and the plastic base 14 is at the connecting tabs 60.

Figure 11:
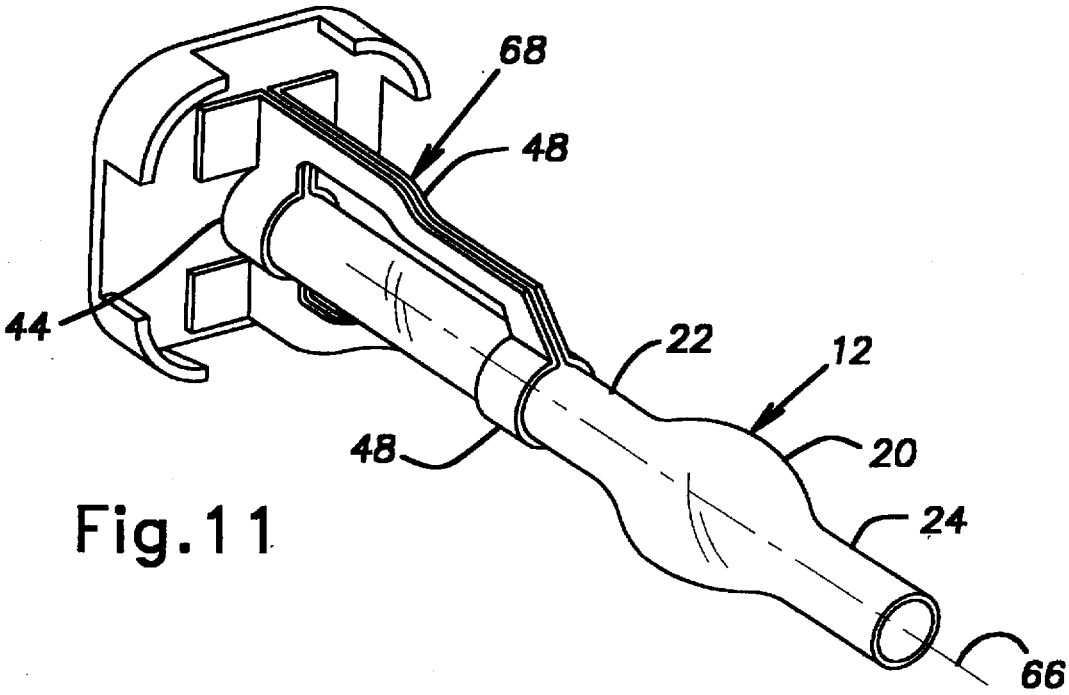
FIG. 11 is a perspective view of a variation of the metal strap of FIG. 1.

FIG. 11 illustrates a metal strap 68 which is a variation of the metal strap 16 of FIGS. 1–10 wherein like numbers are used to identify like structure. The metal strap 68 illustrates that the inner and outer clamping straps 44, 46 can be oriented in different directions. In the illustrated embodiment, the outer clamping straps 46 are oriented about 45 degrees relative to the inner clamping straps 44. To obtain this orientation, the connector arms 48 of the metal strap 16 are twisted in a generally helical manner about the longitudinal axis 66. As shown in FIG. 11, the interface between the inner clamping straps 44 is generally vertical while the interface between the outer clamping straps 46 is generally about 45 degrees from vertical. Twisted in this manner the metal strap is able to better withstand loads in various directions.

Figure 12:
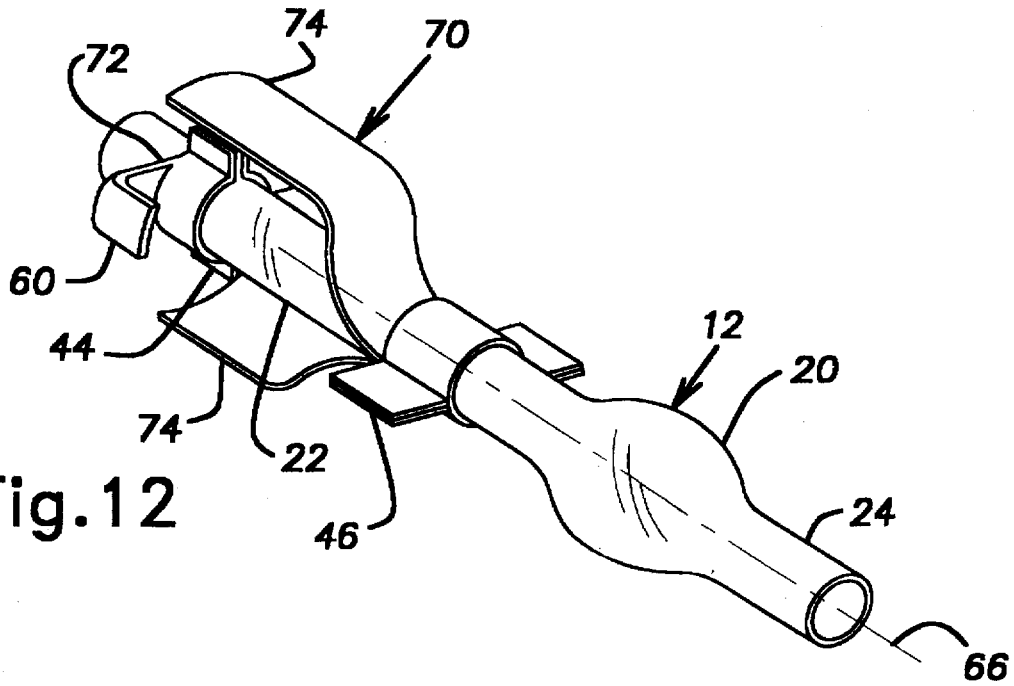
FIG. 12 is a perspective view of another variation of the metal strap of FIG. 1.

FIG. 12 illustrates a metal strap 70 which is another variation of the metal strap 16 of FIGS. 1–10 wherein like numbers are used to identify like structure. The metal strap 70 illustrates that the inner and outer clamping straps 44, 46 can be unconnected. The inner clamping straps 44 are attached to a cap member 72 which has two connecting tabs 60. The outer connecting straps 46 are integrally formed with two additional connecting tabs 74 which longitudinally extend from the outer clamping straps 46 to a position in which they cooperate with the connecting tabs 60 of the cap member 72 to engage the plastic base 14 as described above. In the illustrated embodiment, the interface between the outer clamping straps 46 is oriented generally horizontal and the outer clamping straps 46 are connected to the top and bottom connecting tabs 74 while the interface between the inner clamping straps 44 is generally vertical and the inner clamping straps 44 are attached to the side connecting tabs 60.

Although a particular embodiment of the invention has been described in detail, it will be understood that the invention is not limited correspondingly in scope, but includes all changes and modifications coming within the spirit and terms of the claims appended hereto.

What is claimed is:

1. A lamp with a mounting arrangement for achieving a precise alignment, said lamp comprising:

a light source having a generally cylindrically-shaped neck portion;

base having an internal opening; and a metal strap includes clamping members clamping said light source on said neck portion and a cap member attached to said clamping members and engaging said internal opening of said plastic base, wherein said cap member has tabs each with an outer side engaging said internal opening of said plastic base.

2. The lamp according to claim 1, wherein said light source and said metal strap are movable within said internal opening during an alignment stage to achieve the precise alignment of said light source with respect to said plastic base.

3. The lamp according to claim 1, wherein said plastic base is of a plastic material that softens upon generation of heat to lock said metal strap to said plastic base.

4. The lamp according to claim 1, wherein said outer surfaces of said tabs form a generally spherically-shaped periphery of said metal strap to allow said metal strap the freedom to move inside said plastic base and thereby aligning said light source.

5. The lamp according to claim 1, wherein said light source is a high temperature light source including discharge, halogen, and halogen IR.

6. The lamp according to claim 1, wherein a portion of said plastic base extends around edges of said tabs to interlock metal strap to said base.

7. The lamp according to claim 1, wherein said metal strap includes two clamping members between which the light source is clamped.

8. The lamp according to claim 1, wherein said outer surface of said tabs is circumferentially arcuate.

9. The lamp according to claim 8, wherein said outer surface of said tabs is arcuate both circumferentially and longitudinally.

10. The lamp according to claim 1, wherein said clamping members have integral attachment tabs for joining said clamping members to said cap member.

11. A lamp with a mounting arrangement for achieving a precise alignment, said lamp comprising:

a light source having a generally cylindrically-shaped neck portion;

a plastic base having an internal opening; and a metal strap engaging said internal opening and clamping said light source to secure said light source to said plastic base, said metal strap including first and second pairs of clamping straps which clamp said light source at two longitudinally spaced apart locations on said neck portion, wherein at least one of said first and second pairs of clamping straps is oriented at an angle of about 45 degrees from vertical.

12. The lamp according to claim 11, wherein a first clamping strap of said first pair is connected to a first clamping of said second pair by a first pair of arms and a second clamping strap of said first pair is connected to a second clamping strap of said second pair by a second pair of arms.

13. The lamp according to claim 12, wherein said first pair of arms are joined to said second pair of arms, and said first and second clamping straps of said first pair are connected only through said first and second arms and said first and second clamping straps of said second pair are connected only through said first and second arms such that said first and second pairs of clamping straps clamp said light source with a spring force.

14. The lamp according to claim 12, wherein said arms are twisted such that only one of said first and second pairs of clamping straps are ore oriented at 45 degrees from vertical.

15. The lamp according to claim 12, wherein said arms are oriented about 45 degrees from vertical such that both of said first and second pairs of clamping straps are ore oriented at 45 degrees from vertical.

16. A lamp with a mounting arrangement for achieving a precise alignment, said lamp comprising:

a light source having a generally cylindrically-shaped neck portion;

a plastic base having an internal opening; and a metal strap engaging said internal opening and clamping said light source to secure said light source to said plastic base, said metal strap including first and second pairs of clamping straps which clamp said light source at two longitudinally spaced apart locations on said neck portion, a first clamping strap of said first pair is connected to a first clamping strap of said second pair by a first pair of arms and a second clamping strap of said first pair is connected to a second clamping strap of said second pair by a second pair of arms, said first pair of arms joined to said second pair of arms, wherein said first and second clamping straps of said first pair are connected only through said first and second arms and said first and second clamping straps of said second pair are connected only through said first and second arms such that said first and second pairs of clamping straps clamp said light source with a spring force.

17. The lamp according to claim 16, wherein said first and second pairs of clamping members do not fully encircle said cylindrical portion of said light source.

18. The lamp according to claim 16, wherein at least one of said first and second pairs of clamping members are oriented at an angle of about 45 degrees from vertical.

19. The lamp according to claim 16, wherein said light source is a double-ended type light source.

20. The lamp according to claim 19 wherein said metal strap clamps one end of said light source.

21. A lamp with a mounting arrangement for achieving a precise alignment, said lamp comprising:

a light source having a generally cylindrically-shaped neck portion;

a plastic base having an internal opening; and a metal strap engaging said internal opening and clamping said light source to secure said light source to said plastic base, said metal strap including first and second pairs of clamping straps which clamp said light source at two longitudinally spaced apart locations on said neck portion, wherein said first and second pairs of clamping straps are oriented at different angles.

22. The lamp according to claim 21, wherein one of said first and second pairs of clamping straps is oriented substantially vertically and the other of said first and second pairs of clamping straps is oriented substantially horizontally.

23. A lamp with a mounting arrangement for achieving a precise alignment, said lamp comprising:

a light source having a generally cylindrically-shaped neck portion;

a metal strap clamping said light source at two longitudinally spaced apart locations on said neck portion; and a plastic base having an internal opening engaged by said metal strap, wherein said plastic base is made of a material that softens upon generation of heat to interlock lock said metal strap and said plastic base.

24. The lamp according to claim 23, wherein said metal strap has tabs engaging said internal opening of said plastic base with a spring force and said plastic base extends around edges of said tabs to interlock said metal strap to said base.

* * * * *

UNITED STATES PATENT AND TRADEMARK OFFICE

CERTIFICATE OF CORRECTION

PATENT NO. : 5,684,355
DATED : November 4, 1997
INVENTOR(S) : Douglas G. Seredich, et al.

It is certified that error appears in the above-identified patent and that said Letters Patent is hereby corrected as shown below:

In Col. 5, line 20, Claim 1, before "base" insert --a plastic--.

In Col. 6, line 24, Claim 14, after "are" delete --ore--.

In Col. 6, line 28, Claim 15, after "are" delete --ore--.

In Col. 8, line 8, Claim 23, after "interlock" delete --lock--.

Signed and Sealed this

Tenth Day of November 1998

*Attest:*

Bruce Lehman

BRUCE LEHMAN

*Attesting Officer*

*Commissioner of Patents and Trademarks*